US005126716A

United States Patent [19]

Munger

[11] Patent Number: 5,126,716

[45] Date of Patent: Jun. 30, 1992

[54] ARTIFICIAL RESISTIVE CARD

[75] Inventor: Archer D. Munger, Mesa, Ariz.

[73] Assignee: Motorola, Inc., Schaumburg, Ill.

[21] Appl. No.: 440,929

[22] Filed: Nov. 24, 1989

[51] Int. Cl.[5] ..... H01C 1/012

[52] U.S. Cl. ..... 338/306; 338/314; 338/195

[58] Field of Search ..... 338/306, 307, 308, 314, 338/195; 333/34, 251, 130, 124, 81 B, 248; 428/601, 674; 219/121.68, 121.69; 343/700 MS, 846, 861, 862, 863, 864

[56] References Cited

U.S. PATENT DOCUMENTS 4,931,764 6/1990 Gaston ..... 338/185

*Primary Examiner*—Marvin M. Lateef

*Attorney, Agent, or Firm*—Jordan C. Powell; Frank J. Bogacz

[57] ABSTRACT

An artificial resistive card which prevents scattering due to diffraction, and which forms impedance transitions from ground planes to antenna apertures or to free spaces, incorporates resistive and conductive layers formed on a substrate. The conductive layer is etched away, either partially or entirely, using integrated circuit technology in order to vary the resistivity of the resistive card. Portions of the resistive layer may also be etched away to expose the underlaying substrate and increase the resistivity of the resistive card. The size and dimension of the resistive and conductive pattern left after etching determines the value of the resistivity and is easily and accurately reproduced.

17 Claims, 2 Drawing Sheets $\rho > \rho_0 \Omega/\square$ $\rho < \rho_0 \Omega/\square$

ARTIFICIAL RESISTIVE CARD

BACKGROUND OF THE INVENTION

This invention relates, in general, to surface impedance and sheet resistivity circuits, and more specifically, to repeatable sheet resistivity circuits.

Tapered resistivity surfaces can be termed resistive cards. Resistive cards terminate metal edges to prevent scattering due to diffraction by forming impedance transitions from ground planes to antenna apertures or to free space. Uses of such resistive cards are the reduction of RF side lobes when placed on the ends of antennas, and reduction of scattering from edges of ground planes when located at an antenna's ground plane.

Current methods of producing resistive cards include depositing thin layers of conductive material on a substrate where the resistivity is controlled by the thickness of the layer. One method involves sputtering nickel alloy material onto the substrate. Sputtering, however, is very difficult to control and the distribution of the metal is variable across the resistive card. Other methods of generating resistive cards are similarly limited in controllability and distribution, and the resistivity values after fabrication are hard to determine.

SUMMARY OF THE INVENTION

Accordingly, it is an object of the present invention to provide a reproducible resistive card which is accurately reproduce and inexpensive.

An artificial resistive card which prevents scattering due to diffraction, and which forms impedance transitions from ground planes to antenna apertures or free space, incorporates resistive and conductive layers formed on a substrate. The conductive layer is etched away, either partially or entirely, using integrated circuit technology in order to vary the resistivity of the resistive card. Portions of the resistive layer may also be etched away to expose the underlaying substrate and increase the resistivity of the resistive card. The size and dimension of the pattern left after etching determines the value of the resistivity and is easily and accurately reproduced.

The above and other objects, features, and advantages of the present invention will be better understood from the following detailed description taken in conjunction with the accompanying drawings.

DETAILED DESCRIPTION OF THE INVENTION

Figure 1:
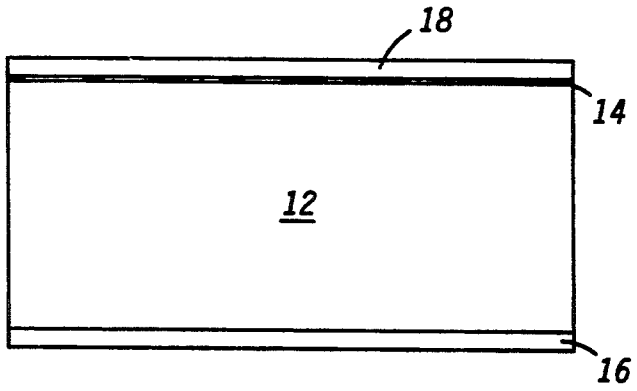
FIG. 1 is cross section of an artificial resistive card according to the present invention.

FIG. 1 shows an artificial resistive card 10 which has a high impedance surface used to prevent scattering of electromagnetic waves due to diffraction. Resistive card 10 is constructed from a resistor-conductor laminate material. Specifically, resistive card 10 comprises substrate 12, resistive layer 14, having $\rho o$ ohms per square, bottom copper layer 16, and copper surface 18.

The bottom copper layer 16 acts as a support and may be an integral part of the associated circuitry.

To generate a resistive surface, copper surface 18 is etched away exposing resistive layer 14 in various patterns. By changing the etched pattern of copper surface 18 and the pattern dimensions, the value of the resistivity is altered.

Figure 2A:
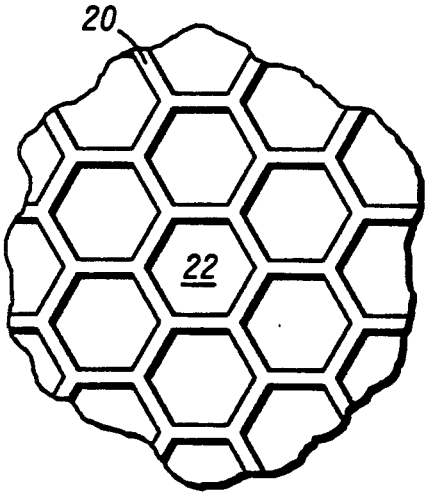
FIG. 2 shows patterns etched on the surface of the preferred embodiment for the artificial resistive card according to the present invention.

FIG. 2 shows one such pattern. The hexagonal pattern of FIG. 2 is an empirically proven optimum pattern for controlling resistivity values in resistive card 10. FIG. 2*a* shows how the hexagonal pattern can generate a surface impedance having resistivity greater than $\rho o$ ohms per square. The pattern lines 20 represent the residual material from resistive layer 14 while the open area 22 represent substrate 12. To construct the pattern of 2*a*, the copper surface 18 is etched away exposing resistive layer 14. Resistive layer 14 is also substantially etched leaving the hexagonal pattern of FIG. 2*a*. Since the exposed substrate 12 has a resistivity much greater than the $\rho o$ ohms per square of resistive layer 14, the resistivity of resistive card 10 increases as greater portions of substrate 12 are exposed.

Figure 2B:
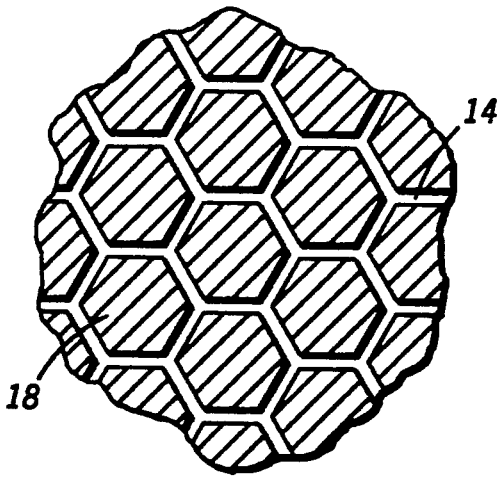

The hexagonal pattern of FIG. 2*b* is a relatively conductive resistive card having resistivity less than $\rho o$ ohms per square. In FIG. 2*b*, copper surface 18 is only etched away along the hexagonal lines revealing resistive layer 14.

The value of the resistivity of both FIGS. 2*a* and 2*b* will depend upon the amount of copper surface 18 remaining or the amount of substrate 12 exposed. Given that resistive layer 14 is $\rho o$ ohms per square in the preferred embodiment, the greater the amount of substrate 12 exposed with copper surface 18 and resistive surface 14 removed, the greater the value of resistivity of resistive card 10. The greater the amount of copper surface 18 remaining after etching the greater the conductivity of resistive card 10. This correlation is presented in graphic form in FIG. 3.

Figure 3:
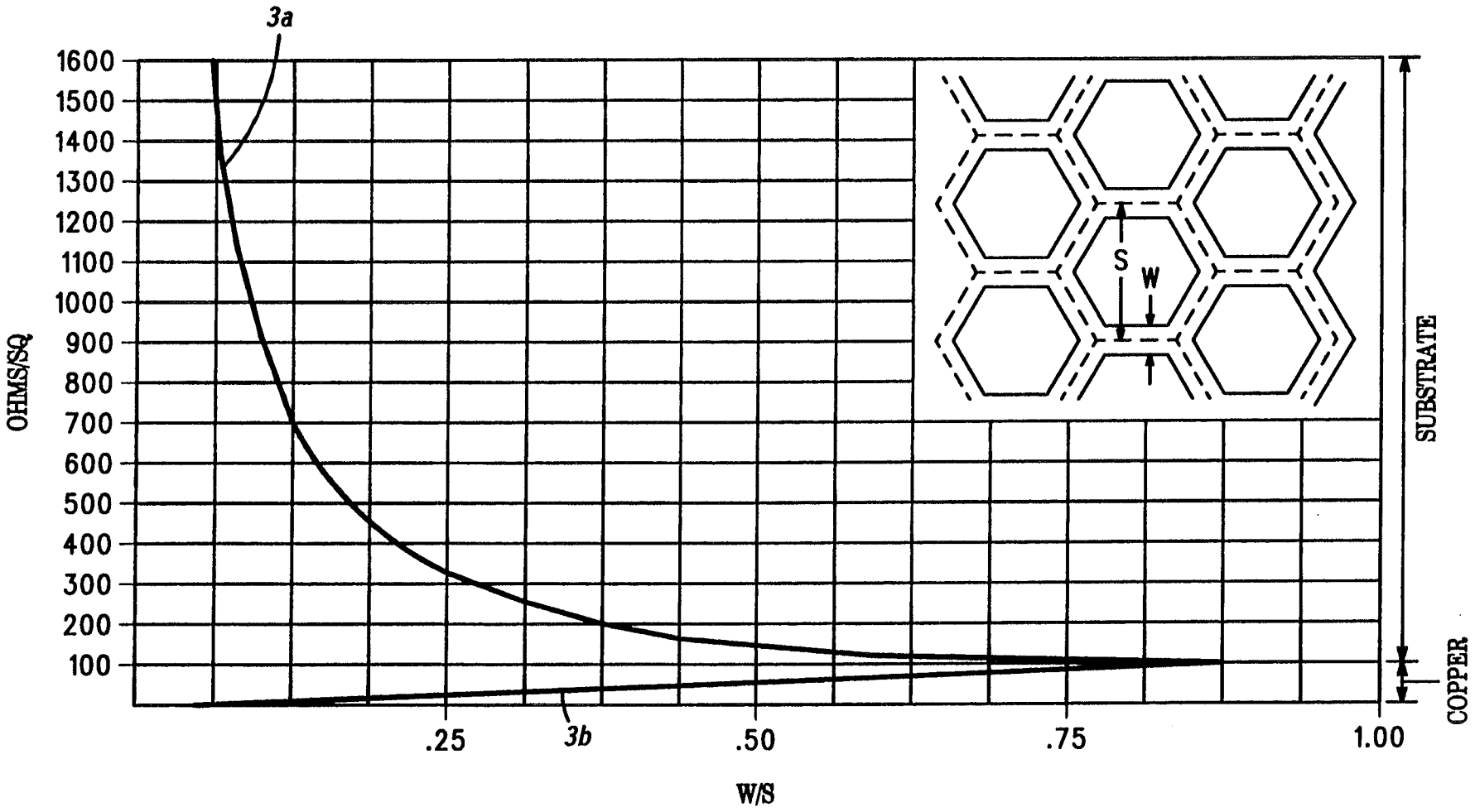
FIG. 3 shows a graphical representation of the resistivity of the resistive card of the present invention as the dimensions of the etched sections vary.

In FIG. 3, a hexagonal pattern having a center-to-center line spacing of S is illustrated. The width of the resistivity layer exposed, represented by W, is measured as a fraction of S and is plotted on the abscissa. The resistivity of resistive card 10 is measured in ohms per square and is plotted on the ordinate. In this example $\rho o = 100$ ohms per square. The resistivity for FIG. 2*a* is represented by plot 3*a*, and the resistivity for FIG. 2*b* is represented by plot 3*b* as shown in FIG. 3. For plot 3*a*, as W approaches 0, the resistivity approaches an infinite impedance. The resistivity approaches 100 ohms as W approaches S. For plot 3*b*, as W approaches 0, resistivity goes to 0, while the resistivity approaches 100 ohms as W increases.

The hexagonal pattern of resistive card 10 is readily reproducible through current integrated circuit technology, and widths and distances can be accurately produced. Other patterns, such as squares or triangles, may also be used and accurately reproduced.

Resistive card 10 may be easily produced in thicknesses from less than 5 to more than 100 mils depending on the thickness of the substrate 12.

Various combinations of resistivity are used in combination in most applications of resistive card 10. For instance, resistive card 10 may be placed around the end of an antenna to reduce side lobe effects. Since the shape of the antenna will vary, thus varying the side lobes, the resistivity of resistive card 10 must vary. Areas of greater conductivity will be incorporated as well as areas of greater resisitivity to create smooth transitions on the antenna. Similarly, varying resistivity of resistive card 10 can be utilized to reduce scattering from edges of antenna ground planes by a transition of the resistivity around the antenna's ground plane to free space.

Thus there has been provided, in accordance with the present invention, an artificial resistive card that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A resistive card for supplying a variable resistive impedance comprising:

first means for supplying a surface impedance;

second means for supplying support to said first means;

first means secured to said second means;

third means for supplying support to said second means;

fourth means for supplying a resistance;

said third means secured to fourth means;

said secured third and fourth means secured to said second means; and fifth means for supplying a conductance.

2. A resistive card according to claim 1 wherein at least a portion of said fifth means is removed to increase said surface impedance.

3. A resistive card according to claim 1 wherein said at least a portion of said fourth means is exposed to increase said surface impedance.

4. A resistive card according to claim 1 wherein said fifth means comprises a copper layer.

5. A resistive card according to claim 1 wherein said third means comprises a copper layer.

6. A resistive card according to claim 1 wherein said fifth means is removed in a predetermined pattern.

7. A resistive card according to claim 6 wherein said predetermined pattern is reproducible.

8. A resistive card according to claim 6 wherein said predetermined pattern is a hexagonal pattern.

9. A resistive card according to claim 6 wherein said predetermined pattern is a rectangular pattern.

10. A resistive card according to claim 6 wherein said predetermined pattern is a triangular pattern.

11. A resistive card according to claim 6 wherein said predetermined pattern comprises a square pattern.

12. A resistive card according to claim 3 wherein said fourth means is exposed in a predetermined pattern.

13. A resistive card according to claim 12 wherein said predetermined pattern is reproducible.

14. A resistive card according to claim 12 wherein said predetermined pattern is a hexagonal pattern.

15. A resistive card according to claim 12 wherein said predetermined pattern is a rectangular pattern.

16. A resistive card according to claim 12 wherein said predetermined pattern is a triangular pattern.

17. A resistive card according to claim 12 wherein said predetermined pattern comprises a square pattern.

* * * * *